US007264412B2

(12) United States Patent
Iwata et al.

(10) Patent No.: US 7,264,412 B2
(45) Date of Patent: Sep. 4, 2007

(54) PRINTER

(75) Inventors: Yasuo Iwata, Saitama (JP); Kazumi Hasegawa, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 286 days.

(21) Appl. No.: 10/513,887

(22) PCT Filed: May 9, 2003

(86) PCT No.: PCT/JP03/05827

§ 371 (c)(1),
(2), (4) Date: Jul. 6, 2005

(87) PCT Pub. No.: WO03/095215

PCT Pub. Date: Nov. 20, 2003

(65) Prior Publication Data

US 2005/0244206 A1 Nov. 3, 2005

(30) Foreign Application Priority Data

May 9, 2002 (JP) ..... 2002-133956

(51) Int. Cl.
*B41J 35/22* (2006.01)

(52) U.S. Cl. ..... 400/206.3; 400/206; 400/206.2; 400/206.4; 400/693.1; 347/214

(58) Field of Classification Search ..... 400/206, 400/206.2, 206.3, 206.4, 207, 214, 693.1; 347/214

See application file for complete search history.

(56) References Cited

U.S. PATENT DOCUMENTS

| | | | | |
|---|---|---|---|---|
| 3,583,315 | A * | 6/1971 | Hebert | 101/96 |
| 4,073,371 | A * | 2/1978 | Prager | 400/216.2 |
| 4,084,503 | A * | 4/1978 | Pylant et al. | 101/96 |
| 4,498,792 | A * | 2/1985 | Falconieri | 400/214 |
| 4,564,303 | A * | 1/1986 | Rosenberg et al. | 400/208 |
| 4,647,232 | A * | 3/1987 | Costa | 400/214 |

FOREIGN PATENT DOCUMENTS

| | | |
|---|---|---|
| JP | 56-64892 | 6/1981 |
| JP | 4-344282 | 11/1992 |
| JP | 5-85026 | 4/1993 |

* cited by examiner

*Primary Examiner*—Daniel J. Colilla
*Assistant Examiner*—Kevin D. Williams
(74) *Attorney, Agent, or Firm*—Westerman, Hattori, Daniels & Adrian, LLP.

(57) ABSTRACT

An ink switching cam (40) is rotated interlockingly with forward/reverse rotation of a head driving motor at all times to swing a cassette support member (20). Accordingly, ink belts can be switched with a simple construction without using a solenoid or the like. By setting a movable area of the ink switching cam (40) to be within one rotation, the operations of a print head (10) and the ink switching cam (40) which are interlocked with the forward/reverse rotation of the head driving motor can be simply associated with each other.

12 Claims, 12 Drawing Sheets

PRINTER

FIELD OF THE INVENTION

The present invention relates to a printer having a mechanism of reciprocatively moving a print head interlockingly with forward and reverse rotation of a head driving motor.

BACKGROUND ART

There has been hitherto known such a printer that an ink ribbon having two color ink belts of black and red arranged in the width direction is loaded in an ink ribbon cassette and one of the ink belts is selected and disposed so as to face a print head by swinging the ink ribbon cassette. Furthermore, with respect to the mechanism of switching the ink ribbon by swinging the ink ribbon cassette, various mechanisms have been also hitherto proposed.

JP-A-56-64892 discloses one of this type ink ribbon switching mechanisms. The ink ribbon switching mechanism disclosed in this publication comprises a print ribbon frame which is reciprocatively moved and vertically swung integrally with a print head, a ribbon switching plate disposed along a movement passage of the print ribbon frame, a red ribbon set mountain formed at one end of the ribbon switching plate and a frame lift member which is equipped integrally with the print ribbon frame and slidable in contact with the ribbon switching plate. That is, when the print ribbon frame is moved in one direction integrally with the print head, the frame lift member is slid in contact with the red ribbon set mountain of the ribbon switching plate and lifted up, so that the print ribbon frame is swung.

The conventional ink ribbon switching mechanism described above has a merit that the structure is more simple and no complicated switching control is needed as compared with other conventional ink ribbon switching mechanisms in which the ink ribbon cassette is swung by using a solenoid or the like. However, the ribbon ink switching mechanism described above is applicable to only a printer having such a structure that an ink ribbon cassette is reciprocatively moved integrally with a print head. Accordingly, in the case of a printer having such a structure that a cassette support member is equipped to a frame and the cassette support member is not moved integrally with a print head (this structure will be hereinafter referred to as a stationary type), an ink ribbon cassette mounted on the cassette support member is not reciprocatively moved, and thus the ink ribbon switching mechanism disclosed in JP-A-56-64892 is not applicable to this type of printer (i.e., a stationary type printer).

DISCLOSURE OF THE INVENTION

The present invention has an object to provide a stationary type printer in which an ink ribbon can be switched with a simple construction.

In order to attain the above object, according to the present invention, a printer for selectively switching plural ink belts formed in the width direction in an ink ribbon, disposing selected one ink belt of the plural ink belts so that the ink belt concerned faces a print head and carrying out a print operation, comprises:

a frame;

a head driving motor which is fixed to the frame and rotates forwardly/reversely;

a print head which is reciprocatively movable interlockingly with the forward/reverse rotation of the head driving motor at all times;

a head feeding mechanism for converting the forward/reverse rotation of the head driving motor to reciprocative movement of the print head;

a cassette support member in which an ink ribbon cassette having an ink ribbon mounted therein is mounted, the cassette support member being swung relatively to the frame to carry out the switching operation on the ink belts; and an ink switching cam which rotates interlockingly with the forward/reverse rotation of the head driving motor at all times and swings the cassette support member to carry out the switching operation on the ink belts.

According to the printer of the present invention described above, the ink switching cam rotates interlockingly with the forward/reverse rotation of the head driving motor at all times, and the cassette support member is swung, whereby the switching operation of the ink belts can be performed by using a simple construction without using any solenoid or the like.

Furthermore, it is preferable that the print head is allowed to be moved from one end of a preset head movable area to the other end thereof or from the other end of the preset head movable area to the one end thereof interlockingly with the forward/reverse rotation of the head driving motor at all times, and also the ink switching cam is allowed to be moved from one end of a preset cam movable area to the other thereof or from the other end of the preset cam movable area to the one end thereof within one rotation interlockingly with the forward/reverse rotation of the head driving motor at all times.

By setting the movable area of the ink switching cam (the cam movable area) within one rotation, the operations of the print head and the ink switching cam which are interlocked with the forward/reverse rotation of the head driving motor at all times can be readily associated with each other, and thus the control can be easily performed.

Here, the ink switching cam may be designed so that the cassette support member is swung from an initial position to a set position at which any one of the ink belts faces the print head.

Furthermore, the printer according to the present invention may be further equipped with a reset-mechanism attached holding unit for holding the cassette support member at the set position and restoring the cassette support member from the set position to the initial position.

The reset-mechanism attached holding unit may contain a holding piece equipped to the frame so that the holding piece is freely movable between preset holding position and release position, and an urging member for urging the holding piece to the holding position, and the cassette support member can be held at the set position when the holding piece is located at the holding position or restored to the initial position when the holding piece is located at the release position.

With the construction described above, the swing operation on the cassette support member to the set position by the ink switching cam, the holding operation on the cassette support member at the set position by the reset-mechanism attached holding unit and the restoring operation on the cassette support member from the set position to the initial position by the reset-mechanism attached holding unit can be firmly controlled. Therefore, the control of these operations can be simplified, and these operations can be properly and surely performed.

Furthermore, in the printer of the present invention, each of the head movable area and the cam movable area contains a print area, a set area provided at one end side of the print area and a reset area provided at the other end of the print area in connection with each other so that the print area is sandwiched between the set area and the reset area, print is carried out by the print head when each of the print head and the ink switching cam is located in the print area, the ink switching cam swings the cassette support member from the initial position to the set position when each of the print head and the ink switching cam is located in the set area, and the reset-mechanism attached unit restores the cassette support member from the set position to the initial position when each of the print head and the ink switching cam is located in the reset area.

As described above, the operations of the print head and the ink switching cam which are interlocked with the forward/reverse rotation of the head driving motor at all times are associated with each other, whereby the control of these operations can be more easily performed.

In this case, the reset-mechanism attached holding unit abuts against the holding piece when the print head gets out of the print area and moves to the reset area, so that the holding piece can be moved to the release position against urging force of the urging member.

Furthermore, the printer of the present invention may be designed so that the head feeding mechanism has a driving transmitting shaft having a screw groove formed thereon so that the print head is fitted in the screw groove, and with respect to the screw groove, a lead angle for defining a feed amount of the print head with respect to the rotation amount of the driving transmitting shaft is set to be smaller in the set area than in the print area.

According to the above construction, in the swing operation of the cassette support member by the ink switching cam, the moving amount of the print head is reduced, and thus the moving stroke of the print head is shortened, so that the printer can be miniaturized.

The printer of the present invention described above may be designed so that rotation of a head driving motor is transmitted through a decelerating mechanism to the ink switching cam. Accordingly, even when the head driving motor makes plural revolutions, the rotation of the ink switching cam can be limited to one revolution or less.

Furthermore, the printer of the present invention may be further equipped with a worm to which the rotation of the head driving motor is transmitted, a worm wheel engaged with the worm, and a ribbon take-up shaft which is rotated by the worm wheel. In this case, it is preferable that only any one of the forward and reverse rotations of the head driving motor is transmitted to the worm wheel or the worm through a one-way clutch.

BEST MODES FOR CARRYING OUT THE INVENTION

Preferred embodiments according to the present invention will be described hereunder with reference to the accompanying drawings.

In this embodiment, the present invention is applied to a stationary type serial dot impact printer, and particularly to a printer in which a print head is reciprocatively moved interlockingly with forward/reverse rotation of a head driving motor.

Figure 1:
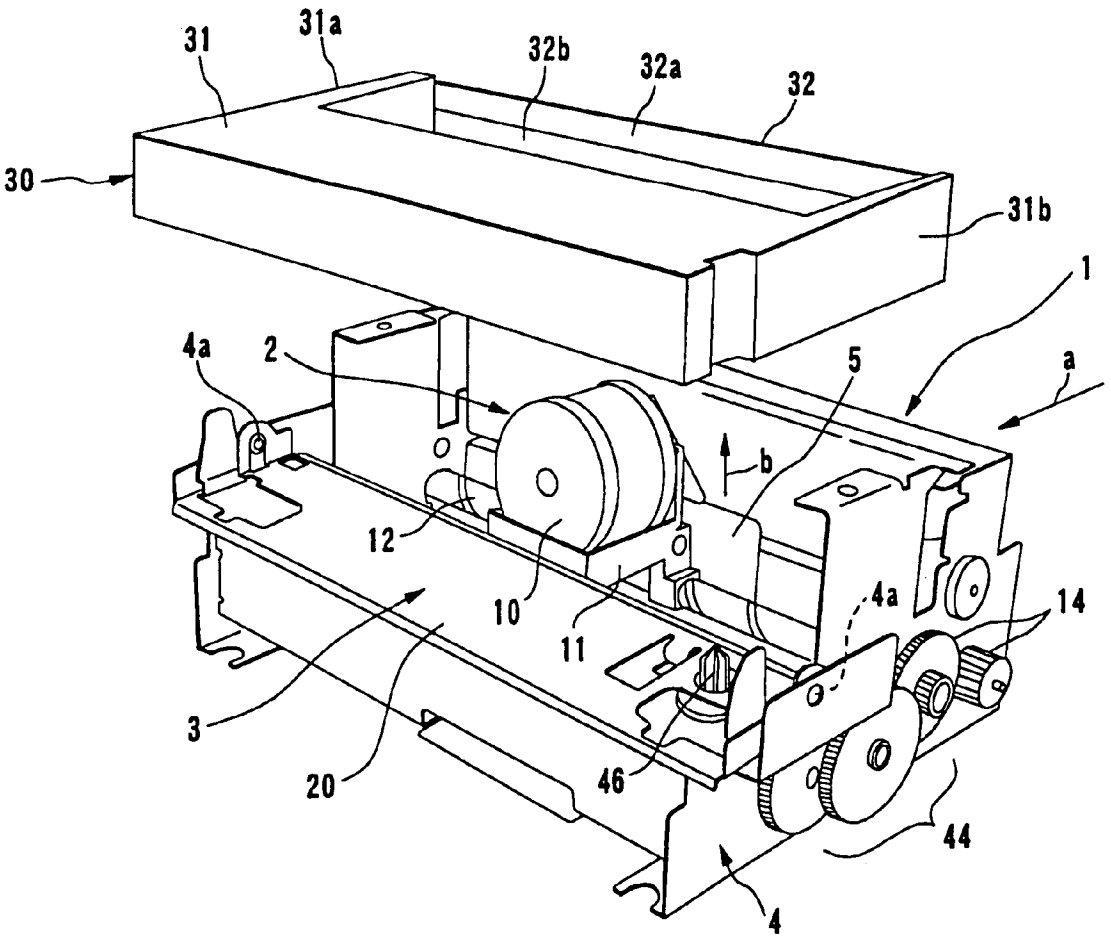
FIG. 1 is a perspective view showing the outlook of a printer according to an embodiment of the present invention.

FIG. 1 is a perspective view showing the outlook of a printer according to the embodiment.

The printer shown in FIG. 1 has a sheet feeding portion 1, a printing portion 2 and a mount portion 3 of an ink ribbon cartridge. The sheet feeding portion 1 is equipped at the back side of a frame 4 constituting a fabric. The mount portion 3 of the ink ribbon cartridge is equipped at the front side of the frame 4, and the printing portion 2 is equipped at the intermediate portion between the sheet feeding portion 1 and the mount portion 3.

A pair of sheet feeding rollers (not shown) are equipped to the sheet feeding portion 1. One of the sheet feeding rollers is a driving roller, and it is rotated by a sheet feeding motor (not shown) fixed to the frame 4. The other sheet feeding roller is a driven roller, and it is rotated while following the rotation of the driving roller. A print medium such as roll paper, cut paper or the like is pinched by the sheet feeding rollers, and fed in connection with the rotation of the rollers. In the printer shown in FIG. 1, after the print medium is fed horizontally from the back side of the frame 4 to the front side (in the direction of an arrow a), the print medium is upwardly (in the direction of an arrow b) guided by a guide plate 5 and fed so as to face the print head 10.

Figure 2:
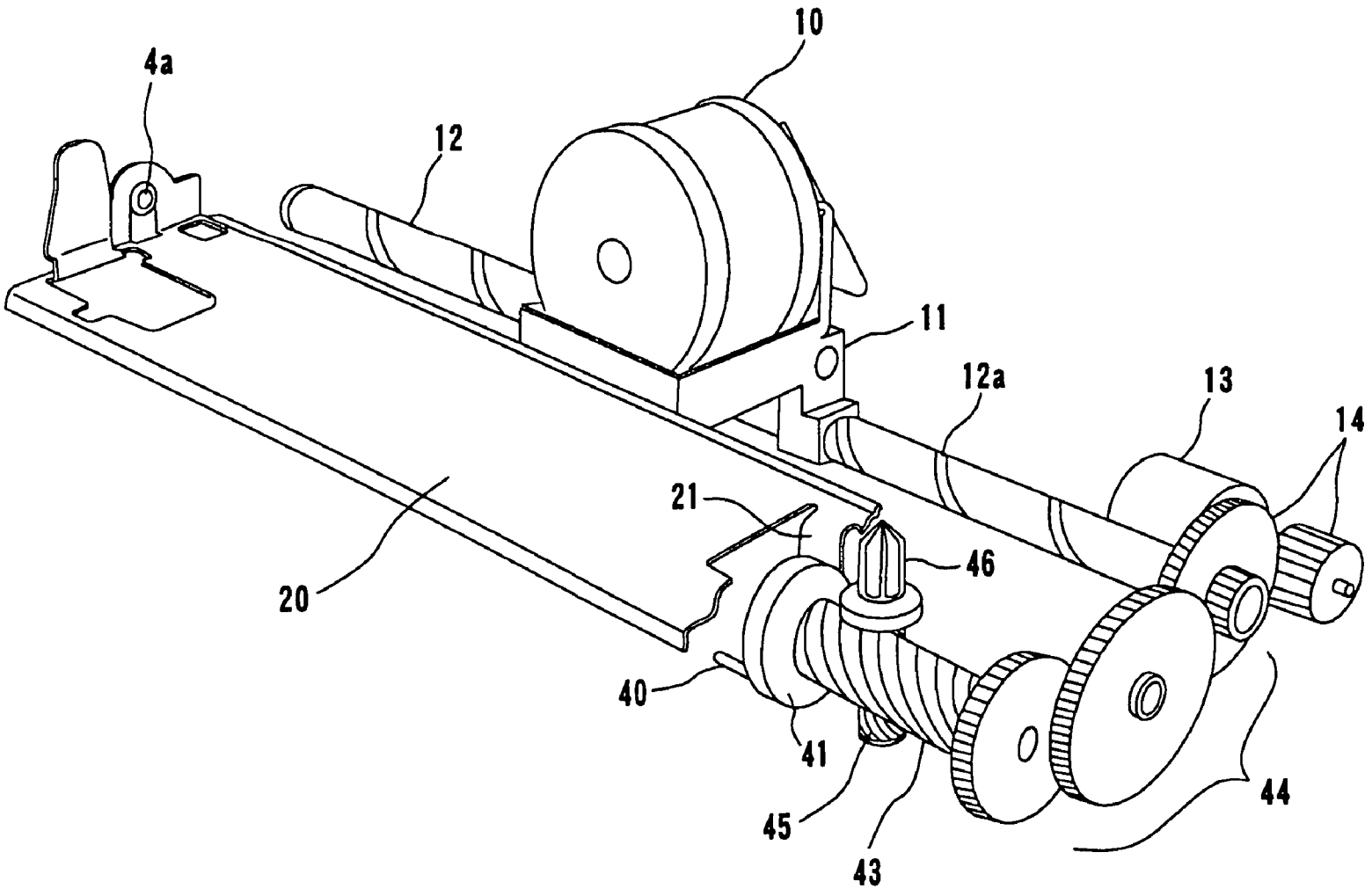
FIG. 2 is a perspective view showing a print portion of the printer shown in FIG. 1 and a mount portion of an ink ribbon cartridge.

As shown in FIG. 2, the print portion 2 is provided with a print head 10, a carriage 11, a driving transmitting shaft 12 and a head driving motor 13. As the print head 10 of this embodiment is adopted a dot impact type print head in which many needles equipped in the print head are projected under the control of electromagnet and an ink ribbon is pressed against the print medium by the projecting needles.

Figure 3:
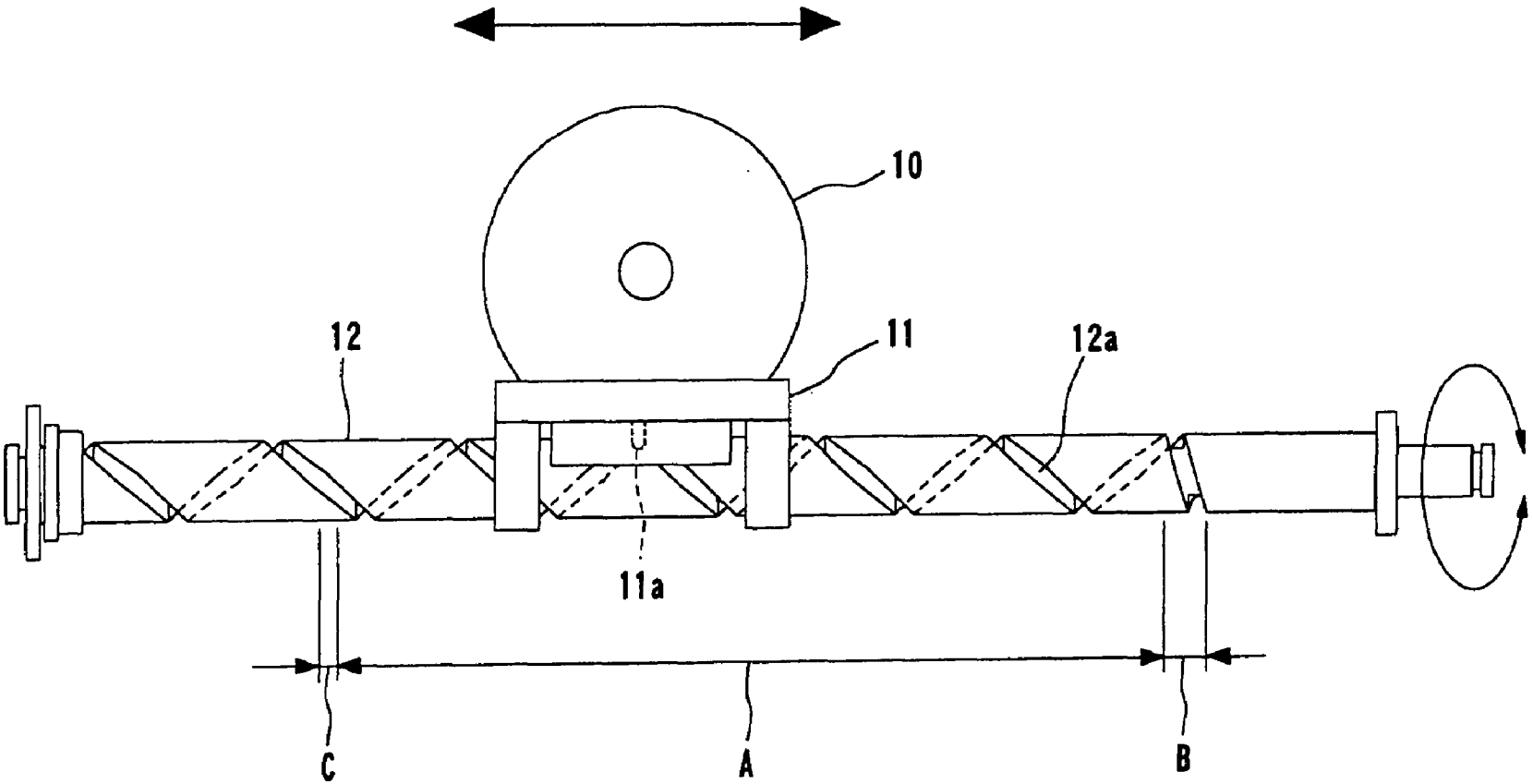
FIG. 3 is a front view showing a print head, a carriage and a driving transmitting shaft provided to a print portion of the printer shown in FIG. 1.

The carriage 11 and the driving transmitting shaft 12 form a head feeding mechanism for converting the forward/reverse rotation of the head driving motor 13 to the reciprocative movement of the print head 10. That is, the print head 10 is mounted on the carriage 11. Furthermore, a screw groove 12*a* is formed on the peripheral surface of the driving transmitting shaft 12 as shown in FIG. 3. The print head 10 is fitted in the screw groove 12*a* through a fitting projection 11*a* equipped to the carriage 11. The rotation of the driving transmitting shaft 12 is converted to the horizontal movement of the print head 10 through the fitting between the fitting projection 11*a* and the screw 12*a*, and the driving transmitting shaft 12 is rotated through a train of transmitting gears 14 by the rotational driving force transmitted from the head driving motor 13 as shown in FIG. 2.

A stepping motor rotating forwardly and reversely is used as the head driving motor 13. By changing the rotational direction of the head driving motor 13, the movement direction of the print head 10 is switched, whereby the print head 10 is reciprocatively moved.

Returning to FIG. 1, a cassette support plate 20 (cassette support member) is disposed on the mount portion 3 of the ink ribbon cartridge. Both the side portions of the cassette support plate 20 are supported by support shafts 4*a* equipped to the frame 4, and freely swingable around the support shafts 4*a*. With respect to the ink ribbon cartridge 30, the cartridge main body 31 is adhesively attached to the upper surface of the cassette support plate 20, and swung integrally with the cassette support plate 20.

A belt-shaped ink ribbon 32 is accommodated in high density in the cartridge main body 31 of the ink ribbon cartridge 30. Arms 31*a* and 31*b* extend from both the side portions of the front side of the cartridge main body 31. With respect to the ink ribbon 32, an unused portion thereof is drawn out from the tip of one arm 31*a* thereof and taken up through the tip of the other arm 31*b* into the cartridge main body 31 again.

As not shown, a gear for taking up the ink ribbon is installed in the neighborhood of the base end of the arm at the take-up side in the cartridge main body 31, and further an engaging hole through which a ribbon take-up shaft 46 described later is joined to the gear is formed at the bottom portion of the cartridge main body.

The ink ribbon 32 is exposed at the intermediate portion between the arms 31*a* and 31*b*. The exposed portion concerned is disposed so as to be adjacent to the front side of the locus of the reciprocative movement of the print head 10. The print medium is fed to a position adjacent to the front side of the ink ribbon 32 by the sheet feeding roller described above.

Plural ink belts 32*a* and 32*b* are arranged in the width direction (in the up-and-down direction of FIG. 1) in the belt-shaped ink ribbon 32. For example, a black ink belt 32*a* and a red ink belt 32*b* are arranged at the upper and lower sides of the ink ribbon 32, respectively. By swinging the ink ribbon cartridge 30, any one of the ink belts 32*a* and 32*b* is disposed so as to face the print head 10, so that black or red color print can be selectively performed.

In this embodiment, the position of the cassette support plate 20 at which the ink belt 32*a* faces the print head 10 is set as an initial position, and the position of the cassette support plate 20 at which the ink belt 32*b* faces the print head 10 is set as a set position as described later.

The printer of this embodiment is equipped with an ink switching cam 40 for swinging the cassette support plate 20 to carry out the switching operation of the ink belts 32*a* and 32*b*.

As shown in FIG. 2, the ink switching cam 40 comprises a pin projecting from a rotating disc 41. It is integrally fixed to one end of a worm 43, and designed so as to be forwardly/reversely rotated interlockingly with the forward/reverse rotation of the head driving motor 13 at all times. The rotational driving force of the head driving motor 13 is transmitted to the ink switching cam 40 through the transmission gear train 14 and a decelerating mechanism 44 comprising plural gears as described above.

The decelerating mechanism 44 is a mechanism for reducing the rotational amount of the ink switching cam 40 to be smaller than the rotational amount of the driving transmitting shaft 12 for driving the print head 10. The decelerating mechanism 44 adjusts the rotational amount of the ink switching cam 40 so that the ink switching cam 40 is forwardly/reversely rotated within one rotation during the period for which the print head 10 moves from one end of a preset movable area (head movable area) to the other end thereof or from the other end of the preset movable area to the one area thereof. That is, the movable area of the ink switching cam 40 (cam movable area) is restricted to one rotation or less.

The worm 43 is engaged with a worm wheel 45, and the worm wheel 45 is joined to a ribbon take-up shaft 46 through a one-way clutch (not shown).

The worm 43 rotates forwardly/reversely in connection with the forward/reverse rotation of the head driving motor 13, and the ribbon take-up shaft 46 is rotated interlockingly with one-way rotation (i.e., only the forward or reverse rotation) of the forward/reverse rotation. The ribbon take-up shaft 46 is engagedly fitted in the fitting hole of the ink ribbon cartridge 30 described above to rotate an ink ribbon take-up gear contained in the cartridge 30. As described above, the printer of this embodiment is designed so as to drive the carriage 11, the ribbon take-up shaft 46 and the ink switching cam 40 by the head driving motor 13, whereby the number of required driving motors is reduced and both miniaturization and reduction in product cost can be performed.

Furthermore, a swinging piece 21 serving as a cam follower for the ink switching cam 40 is formed so as to extend downwardly from the cassette support plate 20 by cutting the cassette support plate 20, and the swing piece 21 thus formed presses the ink switching cam 40 to swing the cassette support plate 20.

Figure 4:
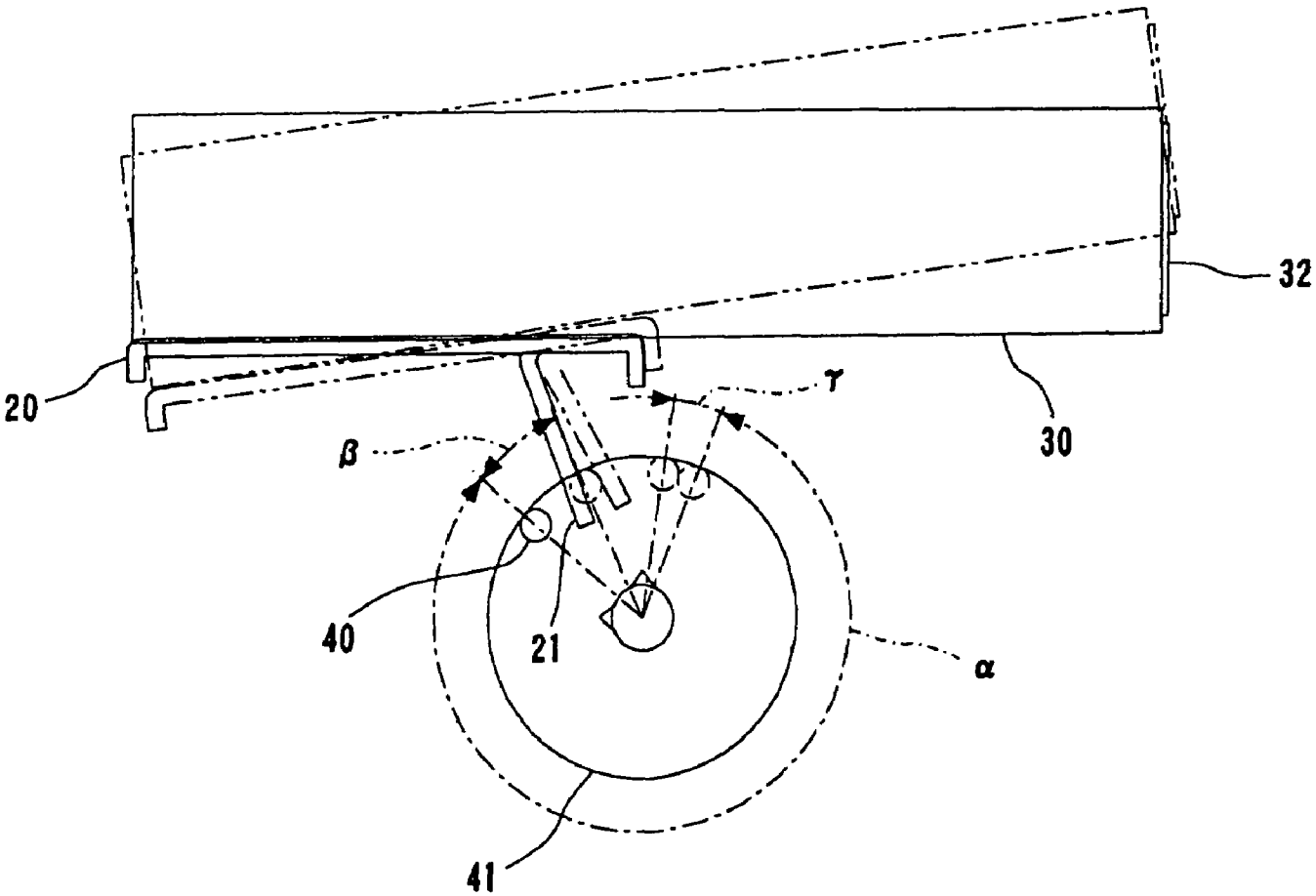
FIG. 4 is a side view showing an ink switching cam and a cassette support plate which are installed in the printer shown in FIG. 1.

FIG. 4 is a side view showing the ink switching cam and the cassette support plate.

The position indicated by a solid line of FIG. 4 corresponds to the initial position of the cassette support plate 20 at which the ink belt 32*a* faces the print head 10, and the position indicated by imaginary lines corresponds to the set position of the cassette support plate 20 at which the ink belt 32*b* faces the print head 10.

The movable area of the ink switching cam 40 (the cam movable area) is sectioned into a print area $\alpha$, and a set area $\beta$ and a reset area $\gamma$ which are disposed at one end side of the print area $\alpha$ and the other end side of the print area $\alpha$ respectively so that the print area $\alpha$ is sandwiched between the set area $\beta$ and the reset area $\gamma$.

Furthermore, as shown in FIG. 3, the movable area of the print head 10 (the head movable area) is sectioned into a print area A, and a set area B and a reset area C which are disposed at one end side of the print area A and the other end side of the print area A respectively so that the print area A is sandwiched between the set area B and the reset area C.

In FIG. 3, the head movable area is defined as an area in which the fitting projection 11*a* provided to the carriage 11 is moved along the screw groove 12*a* of the driving transmitting shaft 12.

When the print head 10 and the ink switching cam 40 are located in the print areas $\alpha$ and A respectively, the print of the print head is carried out. Furthermore, when the print head 10 and the ink switching cam 40 are located in the set areas β and B respectively, the ink switching cam 40 presses the swing piece 21, and swings the cassette support plate 20 from the initial position to the set position, whereby the ink belt 32*b* is disposed so as to face the print head 10.

Furthermore, when the print head 10 and the ink switching cam 40 are located in the reset areas γ and C respectively, a reset-mechanism attached holding unit described later restores the cassette support plate 20 from the set position to the initial position, whereby the ink belt 32*a* is disposed so as to face the print head 10.

Here, with respect to the screw groove 12*a* of the driving transmitting shaft 12, a lead angle for defining the feed amount of the print head with respect to the rotational amount of the driving transmitting shaft 12 is set as follows. That is, as shown in FIG. 3, the lead angle in the print area A is set to be smaller than the lead angle in the set area B. Accordingly, during the swing operation of the cassette support plate 20 by the ink switching cam 40, the movement amount of the print head 10 is reduced, and the moving stroke of the print head 10 is shortened, so that the miniaturization of the printer can be implemented.

Figure 5A:
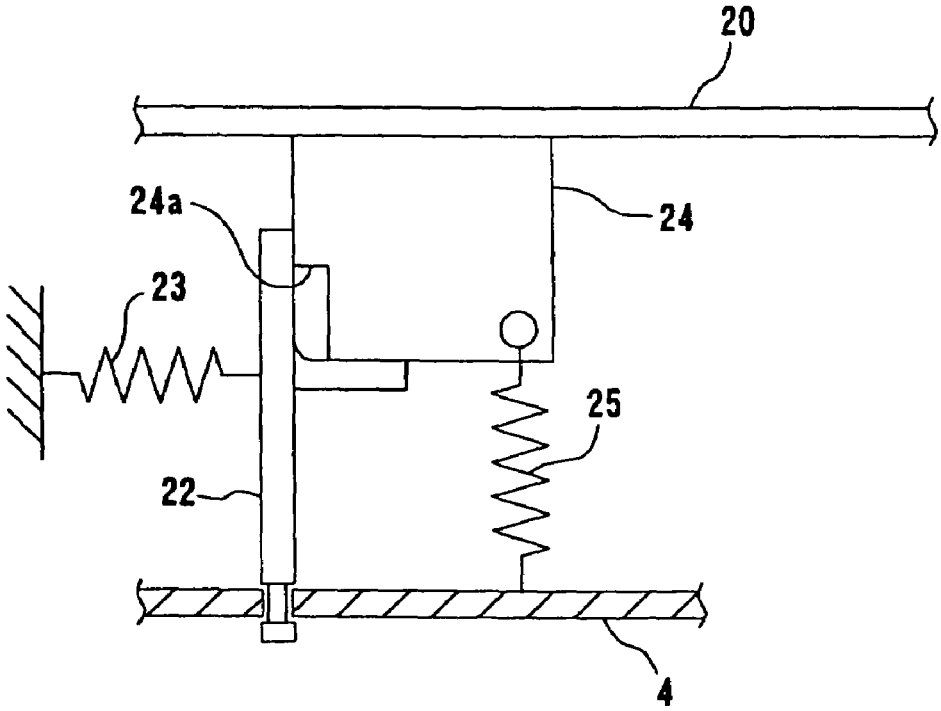
FIGS. 5A and 5B are front views showing a reset-mechanism attached holding unit installed in the printer shown in FIG. 1.
Figure 5B:
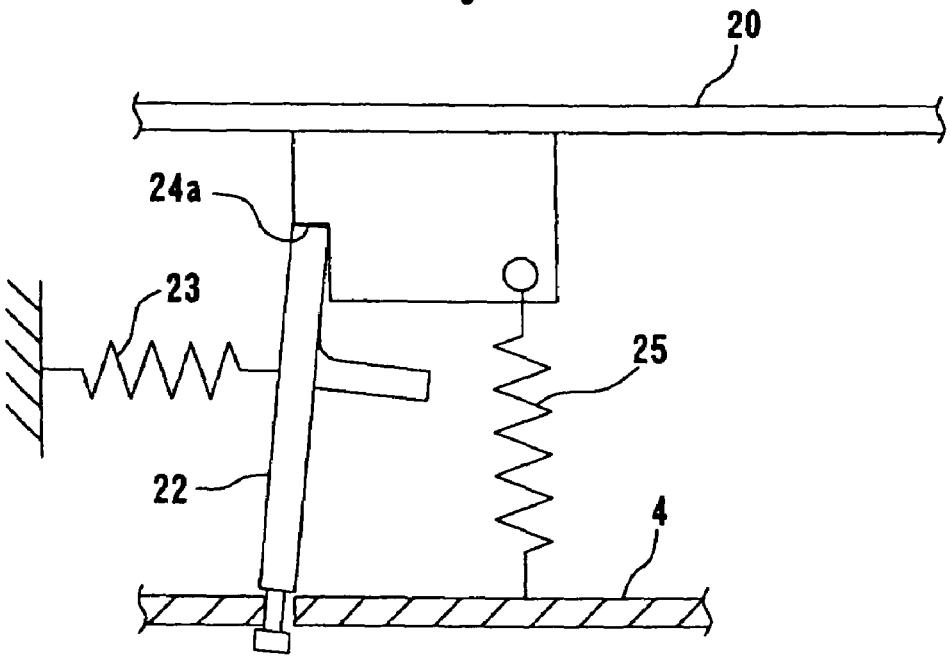

FIGS. 5A and 5B are front views showing the reset-mechanism attached holding unit.

The printer of this embodiment is equipped with the reset-mechanism attached holding unit (reset-mechanism attached holding means) for holding the cassette support plate 20 at the set position and restoring the cassette support plate 20 from the set position to the initial position.

The reset-mechanism attached holding unit comprises a holding piece 22, an urging member 23 comprising a coil spring etc., and an engaging piece 24 of the cassette support plate 20. The holding piece 22 is provided with the frame 4 so as to be freely movable between preset holding position (the position of FIG. 5B) and release position (the position of FIG. 5A). The urging member 23 urges the holding piece 22 toward the holding position.

The engaging piece 24 is formed so as to extend downwardly from the cassette support plate 20 by cutting the cassette support plate 20, and the holding piece 22 is brought into contact with the side edge of the engaging piece 24. An engaging step portion 24*a* (engaging portion) is formed at the side edge of the engaging piece 24, and in connection with the swing motion of the cassette support plate 20, the engaging step portion 24*a* is moved upwardly until it is engaged with the holding piece 22. Accordingly, the holding piece 22 is moved to the holding position shown in FIG. 5B, and the cassette support plate 20 is held at the set position.

The reset-mechanism attached holding unit described above is positioned so that the side surface of the carriage 11 abuts against the holding piece 22 when the fitting projection 11*a* provided to the carriage 11 comes to the reset area C. When the carriage 11 moves in the direction from the right side to the left side in FIG. 5B, the side surface of the carriage 11 abuts against the holding piece 22, and moves the holding piece 22 to the release position shown in FIG. 5A, whereby the engagement state between the holding piece 22 and the engaging step portion 24*a* is released.

The cassette support plate 20 is always urged by he urging member 25 such as the coil spring or the like in such a direction that it is returned from the set position to the initial position. Accordingly, when the engagement state between the holding piece 22 and the engaging step portion 24*a* is released, the cassette support plate 20 is moved by the urging force of the urging member 25 as shown in FIG. 5A, and restored to the initial position.

The present invention is not limited to the above embodiment.

For example, the shape of the ink switching cam is not limited to a pin shape as shown in FIGS. 2 and 4. Furthermore, the above embodiment may be modified so that the carriage is omitted and the print head is directly fitted to the driving transmitting shaft. Furthermore, the reset-mechanism attached holding unit may adopt various constructions other than the construction shown in FIGS. 5A and 5B.

The ink ribbon may be designed so that ink belts other than the above two color ink belts, for example, plural black color ink belts may be arranged in the width direction, or three or more ink belts are arranged in the width direction.

The ink ribbon in which plural black color ink belts are arranged in the width direction is apparently viewed as being formed of a single black ink belt. However, if it is designed so that a part of the ink belt in the width direction is disposed so as to face the print head by selective switching operation, it is contained in the concept of the ink ribbon to which the present invention is applicable.

With respect to an ink ribbon having three or more ink belts formed in the width direction thereof, the set area of the ink switching cam is divided into sub set areas whose number is equal to the number achieved by subtracting 1 from the number of ink belts, and the cassette support member is stepwise swung. In this case, it is preferable that the cam movable area is also limited to one rotation or less. Furthermore, it is preferable that the reset-mechanism attached holding unit holds the set support member at each of swing positions in connection with the number of sub set areas achieved by dividing the set area.

Figure 6:
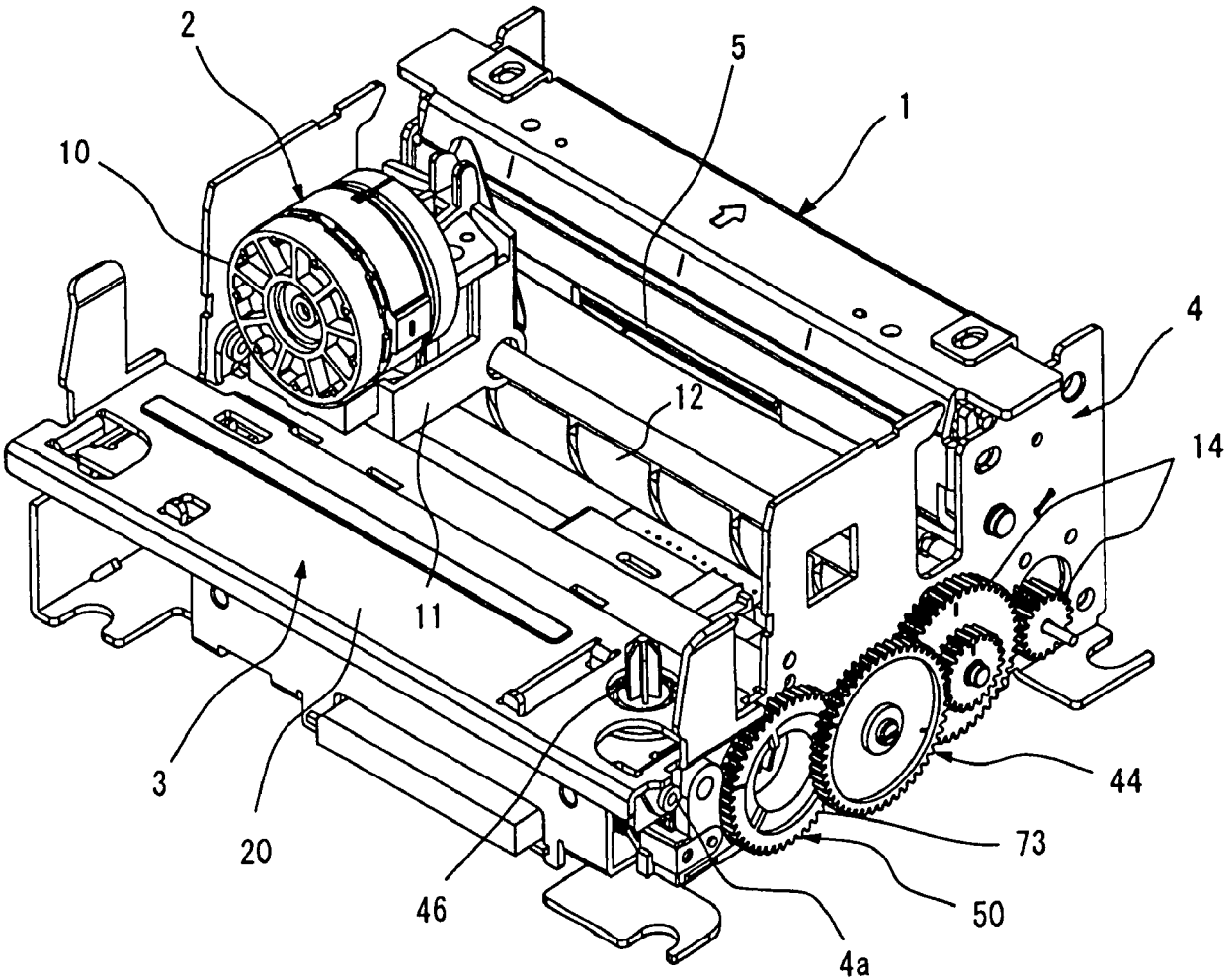
FIG. 6 is a perspective view showing the outlook of a printer which is actually manufactured by the applicant of this application on the basis of the present invention when no ink ribbon cartridge is mounted.
Figure 7:
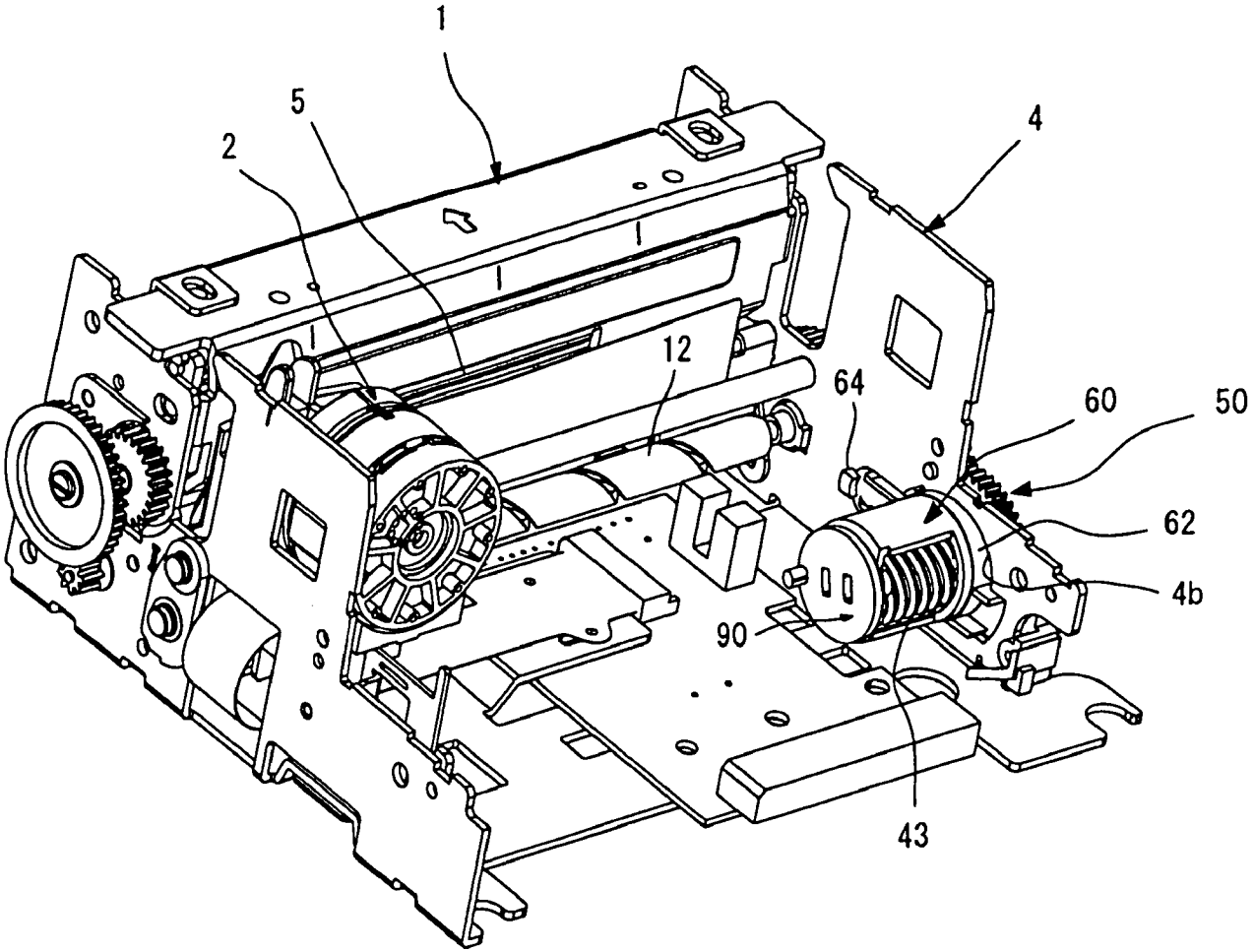
FIG. 7 is a perspective view showing the inner surface of a frame constituting the printer which is actually manufactured by the applicant of this application on the basis of the present invention.
Figure 8:
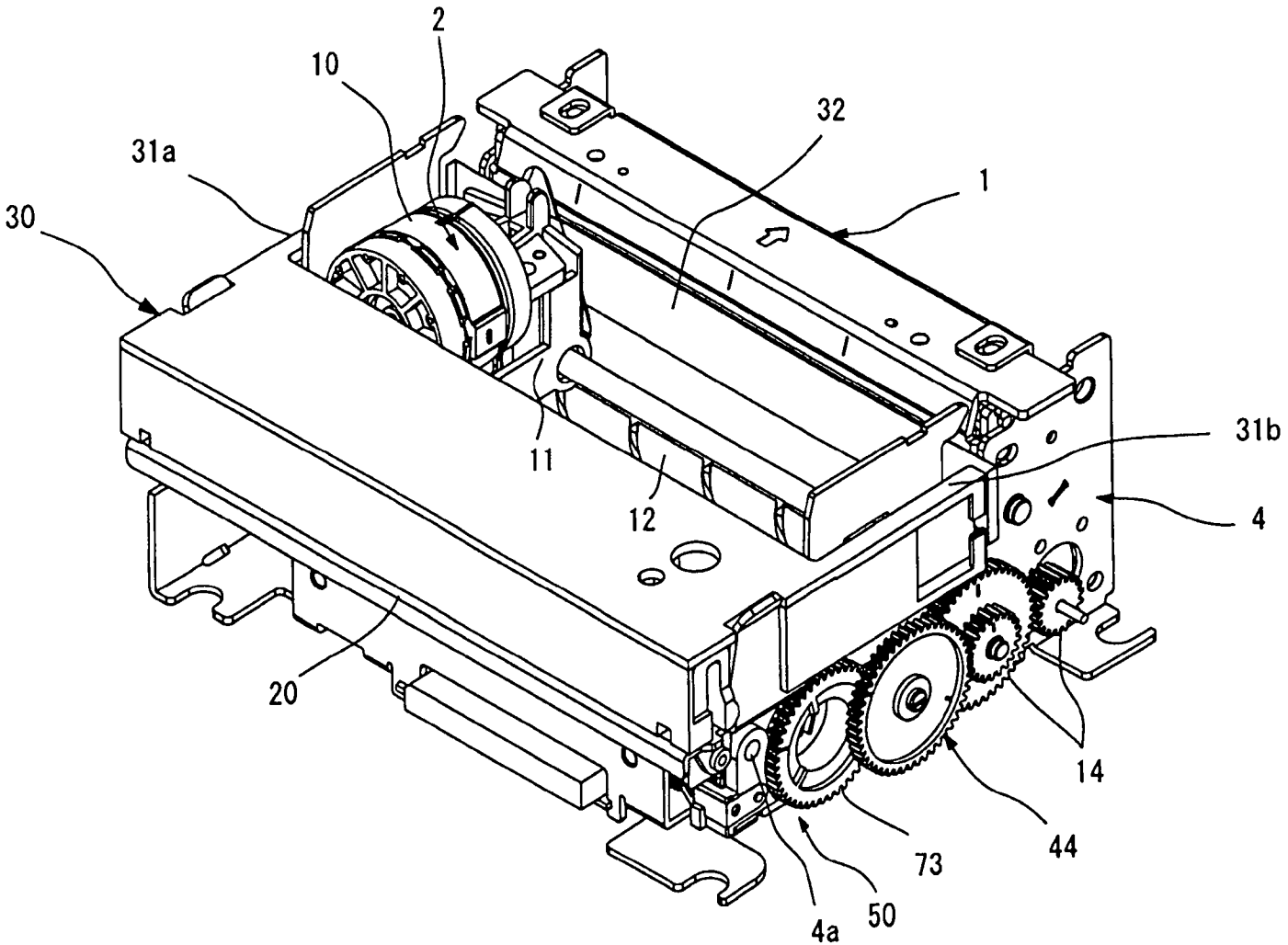
FIG. 8 is a perspective view showing the outlook of the printer which is actually manufactured by the applicant of this application on the basis of the present invention when an ink ribbon cartridge is mounted.
Figure 9:
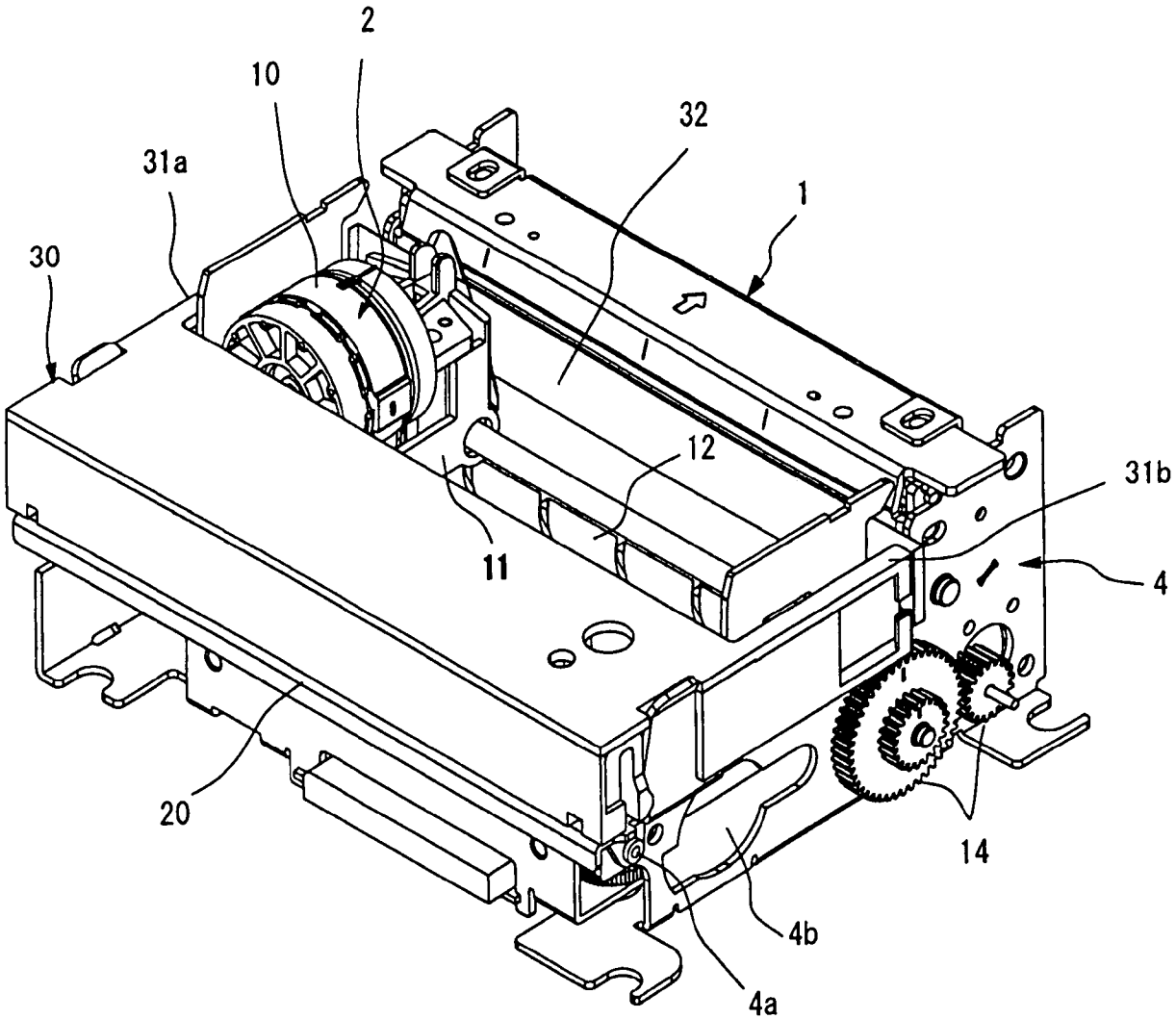
FIG. 9 is a perspective view showing the outlook of the printer when a worm unit shown in FIG. 8 is detached.

FIGS. 6 to 9 are perspective views showing the outlook of a printer manufactured by the applicant on the basis of the present invention. Specifically, FIG. 6 is a perspective view showing the outlook of the printer when no ink ribbon cartridge is loaded, FIG. 7 is a perspective view showing the inner surface of the frame constituting the printer, FIG. 8 is a perspective view showing the outlook of the printer when an ink ribbon cartridge is loaded, and FIG. 9 is a perspective view showing the printer when a worm unit shown in FIG. 8 is detached.

The constituent elements of the printer shown in the above figures which correspond to the elements of the printer shown in FIGS. 1 to 5 are represented by the same reference numerals.

The printer shown in FIGS. 6 to 9 is achieved by changing the design of the constituent elements relating to the worm 43, the ink switching cam 40, the rotating disc 41 and the worm wheel 45. The design change concerned is not a mere design change which can be routinely made by persons skilled in the art, but has been implemented as a result of inventor's enthusiastic studies.

Figure 10:
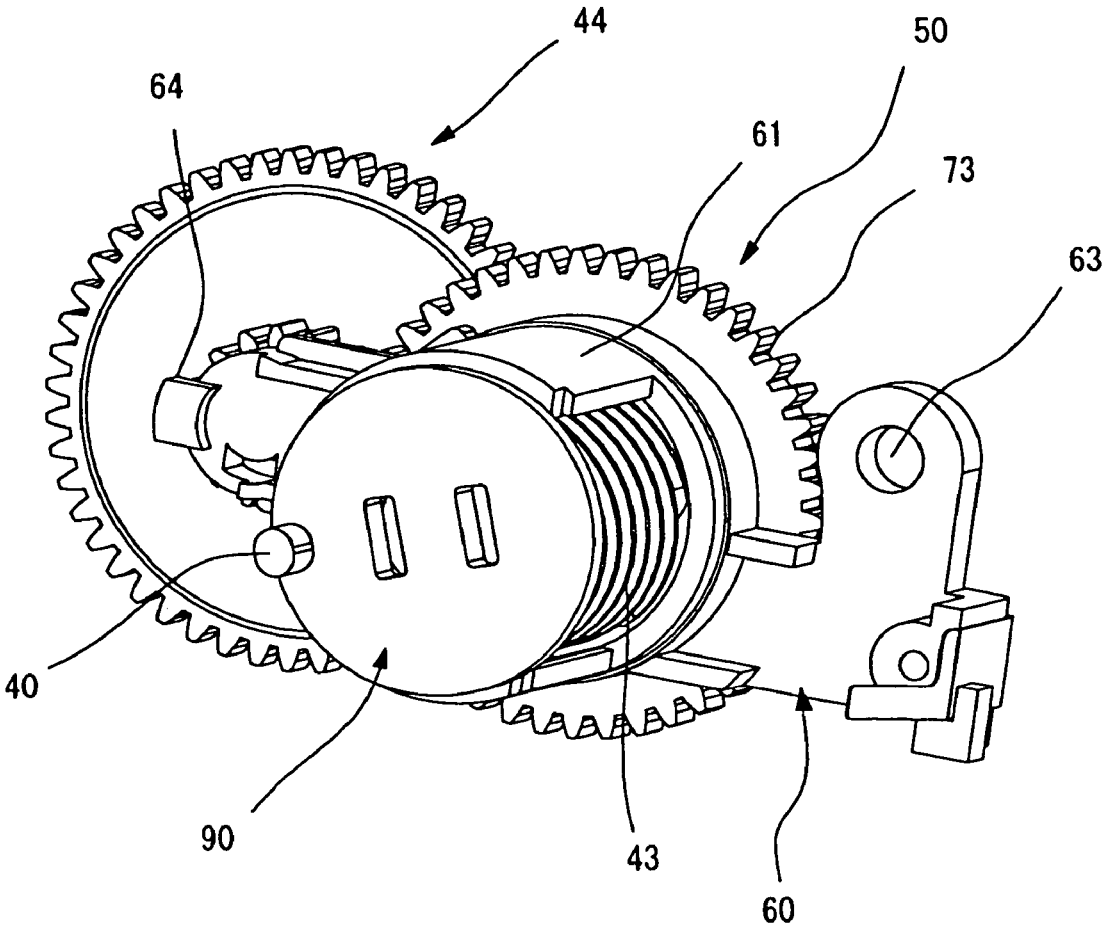
FIG. 10 is a perspective view showing the outlook of the worm unit.
Figure 11:
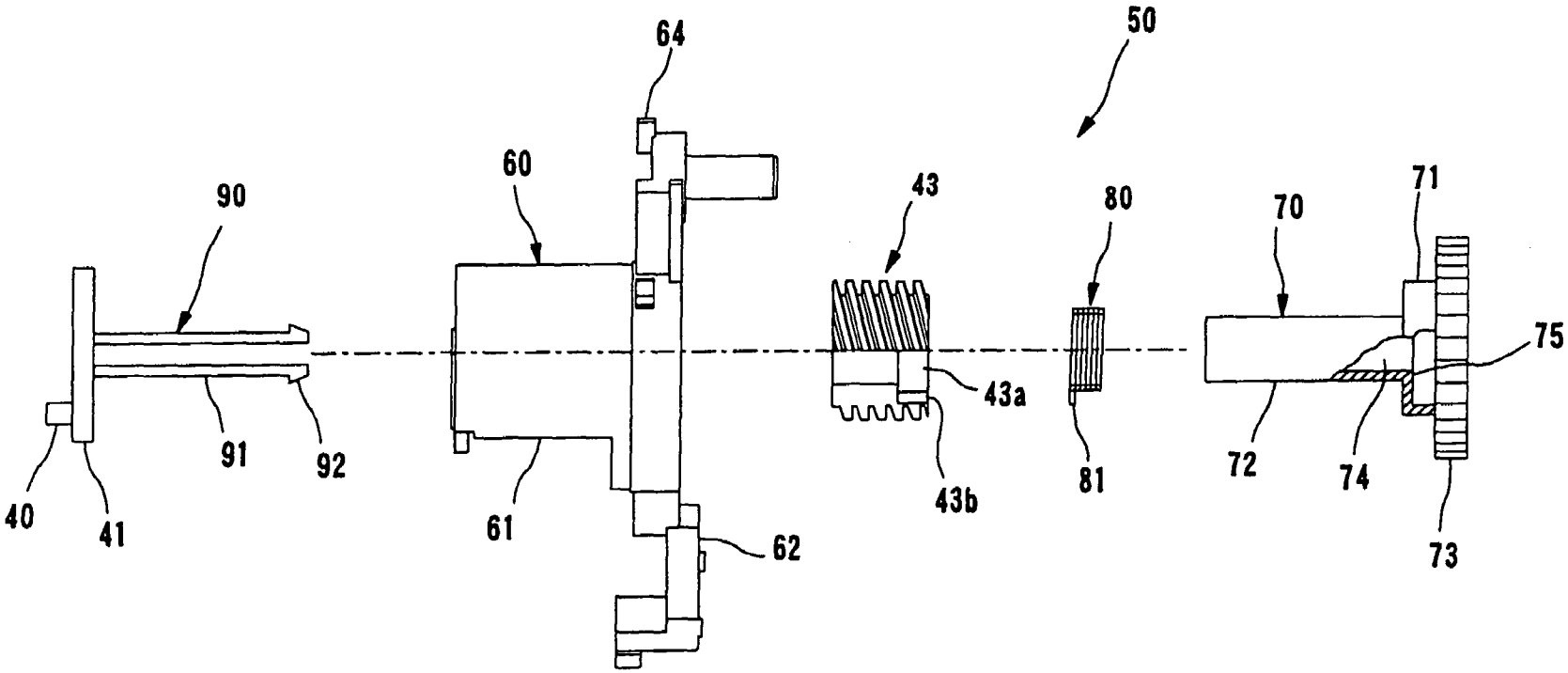
FIG. 11 is an exploded plan view showing the worm unit.

That is, the printer shown in these figures is equipped with a worm unit 50 having the outlook shown in FIG. 10. As shown in FIG. 11, the worm unit 50 comprises a worm holder 60, a shaft member 70, a spring clutch 80, a worm 43 and a cam member 90.

Figure 12A:
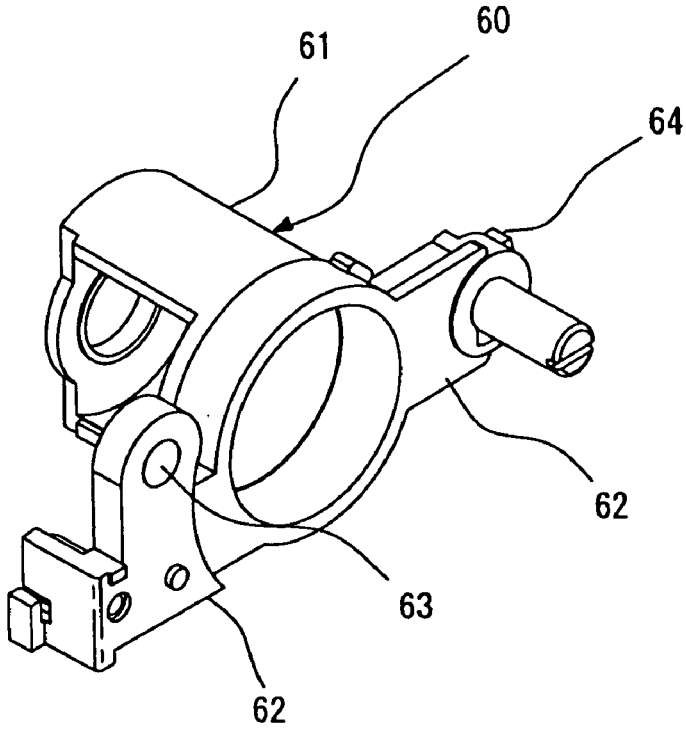
FIGS. 12A and 12B are perspective views showing the outlook of a worm holder constituting the worm unit.
Figure 12B:
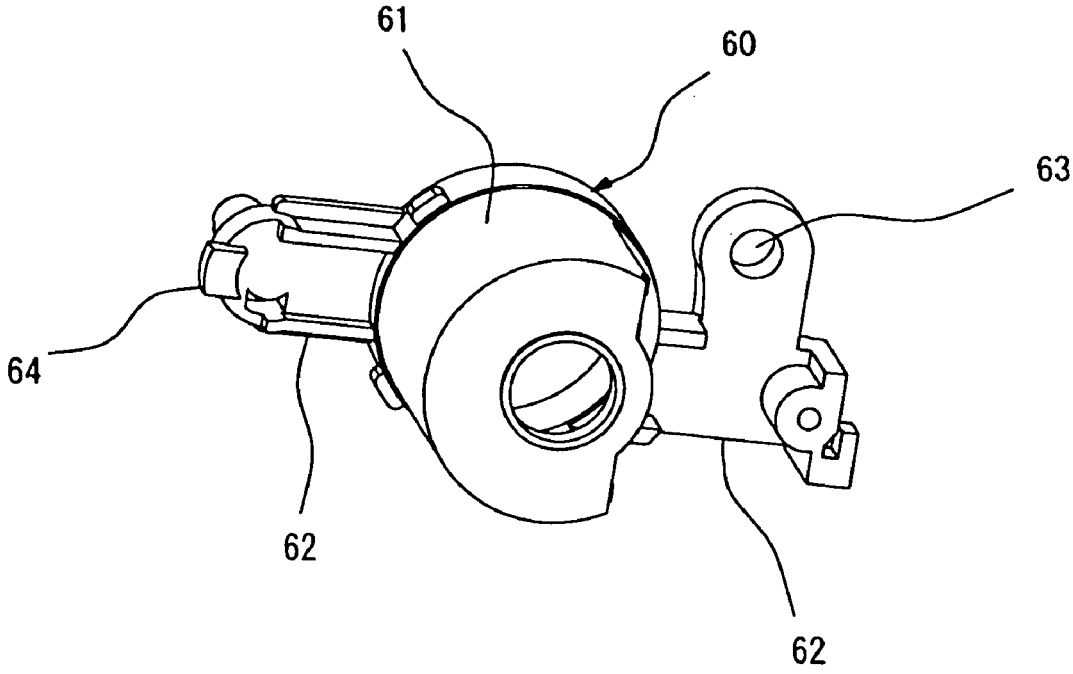

As shown in FIGS. 12A and 12B, the worm holder 60 has a worm accommodating portion 61 and a mount portion 62 to the frame 4. The worm 43 is accommodated in the worm accommodating portion 61. The mount portion 62 is provided so as to extend from the base end surface of the worm accommodating portion 61 to both the outward sides thereof. A joint hole 63 is formed in one extending portion of the mount portion 62, and a fitting portion 64 to the frame 4 is formed.

The shaft member 70 has a disc-shaped base 71, a sleeve 72 and a deceleration gear 73. The sleeve 72 is designed in a rod-shape, and extends from the center portion of one end surface of the base 71. An insertion hole 74 having a rectangular section is formed in the center axial portion of the sleeve 72. The inside of the base 71 is hollow, and a step portion 75 is formed at the intercommunication portion of the base 71 with the insertion hole 74. The deceleration gear 73 is provided to the other end surface of the base 71. The deceleration gear 73 is one of the gears constituting the decelerating mechanism 44 (see FIG. 1) described above.

The spring clutch 80 is formed of a coil spring, and loosely fitted on the outer peripheral surface of the sleeve 72. One end of the spring clutch 80 forms a projecting portion 81 so that the projecting portion 81 extends outwardly.

The worm 43 has teeth formed on the outer peripheral surface thereof, and the inside thereof is hollow. An accommodating portion 43*a* for the spring clutch 80 is formed in the hollow portion of the worm 43, and the spring clutch 80 is loosely fitted on the outer peripheral surface of the sleeve 72 while inserted in the accommodating portion 43*a* of the worm 43. A key groove 43*b* is formed in the accommodating portion 43*a*, and the projecting portion 81 of the spring clutch 80 is fitted in the key groove 43*b*.

A cam member 90 is equipped with the ink switching cam 40 projecting from one end surface of the rotating disc 41, and also an engaging hook 91 extends from the other end surface of the rotating disc 41. The engaging hook 91 is inserted from the tip surface side (the left side of FIG. 11) of the worm holder 60 into the insertion hole 74 of the sleeve 72 disposed in the worm accommodating portion 61, and a pawl portion 92 at the tip of the engaging hook 91 is fitted to the step portion 75 in the base 71.

In the worm unit 50 thus constructed, after the spring clutch 80 and the worm 43 are loosely fitted on the outer peripheral surface of the sleeve 72, the sleeve 72, the spring clutch 80 and the worm 43 are accommodated from the one end surface side (the right side of FIG. 11) in the worm holder 60. Subsequently, the engaging hook 91 of the cam member 90 is inserted from the opposite side (the left side of FIG. 11) of the worm holder 60, and the pawl portion 92 at the tip is fitted to the step portion 75 in the base 71 through the insertion hole 74 of the sleeve 72, thereby completing the worm unit 50 having the outlook shown in FIG. 10.

The worm unit 50 thus constructed is installed into the printer by mounting the mount portion 62 of the worm holder 60 in the mount hole 4*b* of the frame 4 shown in FIG. 9. At this time, the fitting portion 64 of the worm holder 60 is fitted to the edge of the mount hole 4*b* (see FIG. 7). Furthermore, a fastening tool such as a screw or the like is inserted in a fastening hole 63 of the worm holder 60, and the worm unit 50 is fixed to the frame 4 by the fastening tool.

The decelerating gear 73 is forwardly/reversely rotated in connection with the forward/reverse rotation of the head driving motor 13, and the sleeve 72 and the cam member 90 are rotated interlockingly with the forward/reverse rotation. Only one-way rotation is transmitted to the worm 43 through the spring clutch 80.

That is, when the sleeve 72 is rotated in one direction, the spring clutch 80 is fastened by friction force between the spring clutch 80 and the sleeve 72, and reduced in diameter, so that it is firmly wound around the peripheral surface of the sleeve 72. Through the first winding of the spring clutch 80 around the sleeve 72 as described above, the rotational force is transmitted to the worm 43 through the projecting portion 81 of the spring clutch 80.

On the other hand, when the sleeve 72 is reversely rotated, the spring clutch 80 is expanded, and thus slipping occurs between the sleeve 72 and the spring clutch 80, so that no rotational force is transmitted to the worm 43. As shown in FIG. 2, the worm 43 is engaged with the worm wheel 45 for rotating the ribbon take-up shaft 46, and one-way rotation of the head driving motor 13 is transmitted to the worm wheel 45 through the worm 43, so that the ribbon take-up shaft 46 is rotated.

As described above, in the printer using the worm unit 50, the worm 43 is rotated in one direction through the spring clutch 80 (one-way clutch). Therefore, no one-way clutch is contained in the worm wheel 45.

INDUSTRIAL APPLICABILITY

As described above, according to the printer of the present invention, the ink switching cam is rotated interlockingly with the forward/reverse rotation of the head driving motor at all times to swing the cassette support member. Accordingly, the switching operation of the ink belts can be performed with a simple construction without using any solenoid.

What is claimed is

1. A printer for selectively switching plural ink belts formed in the width direction in an ink ribbon, disposing selected one ink belt of the plural ink belts so that the ink belt concerned faces a print head and carrying out a print operation, comprises:

a frame;

a head driving motor which is fixed to the frame and rotates forwardly/reversely;

a print head which is reciprocatively movable interlockingly with the forward/reverse rotation of the head driving motor at all times;

a head feeding mechanism for converting the forward/reverse rotation of the head driving motor to reciprocative movement of the print head;

a cassette support member in which an ink ribbon cassette having an ink ribbon mounted therein is mounted, the cassette support member being swung relatively to the frame to carry out the switching operation on the ink belts; and an ink switching cam which rotates interlockingly with the forward/reverse rotation of the head driving motor at all times and swings the cassette support member to carry out the switching operation on the ink belts.

2. The printer according to claim 1, wherein the print head is allowed to be moved from one end of a preset head movable area to the other end thereof or from the other end of the preset head movable area to the one end thereof interlockingly with the forward/reverse rotation of the head driving motor at all times, and also the ink switching cam is allowed to be moved from one end of a preset cam movable area to the other thereof or from the other end of the preset cam movable area to the one end thereof within one rotation interlockingly with the forward/reverse rotation of the head driving motor at all times.

3. The printer according to claim 1, wherein the ink switching cam is designed so that the cassette support member is swung from an initial position to a set position at which any one of the ink belts faces the print head.

4. The printer according to claim 3, further comprising a reset-mechanism attached holding unit for holding the cassette support member at the set position and restoring the cassette support member from the set position to the initial position.

5. The printer according to claim 4, wherein each of the head movable area and the cam movable area contains a print area, a set area provided at one end side of the print area and a reset area provided at the other end of the print area in connection with each other so that the print area is sandwiched between the set area and the reset area, print is carried out by the print head when each of the print head and the ink switching cam is located in the print area, the ink switching cam swings the cassette support member from the initial position to the set position when each of the print head and the ink switching cam is located in the set area, and the reset-mechanism attached holding unit restores the cassette support member from the set position to the initial position when each of the print head and the ink switching cam is located in the reset area.

6. The printer according to claim 5, wherein the reset-mechanism attached holding unit comprises a holding piece which is provided to the frame so as to be freely movable between preset holding position and release position, and an urging member for urging the holding piece to the holding position, and the reset-mechanism attached holding unit holds the cassette support member at the set position when the holding piece is located at the holding position and restores the cassette support member to the initial position when the holding piece is located at the release position.

7. The printer according to claim 6, wherein the reset-mechanism attached holding unit abuts against the holding piece when the print head gets out of the print area and moves to the reset area, so that the holding piece can be moved to the release position against urging force of the urging member.

8. The printer according to claim 1, wherein the head feeding mechanism has a driving transmitting shaft having a screw groove formed thereon so that the print head is fitted in the screw groove, and with respect to the screw groove, a lead angle for defining a feed amount of the print head with respect to the rotation amount of the driving transmitting shaft is set to be smaller in the set area than in the print area.

9. The printer according to claim 1, further comprising a decelerating mechanism through which rotation of the head driving motor is transmitted to the ink switching cam.

10. The printer according to claim 1, wherein a worm to which the rotation of the head driving motor is transmitted, a worm wheel engaged with the worm, and a ribbon take-up shaft which is rotated by the worm wheel.

11. The printer according to claim 10, wherein only any one of the forward and reverse rotations of the head driving motor is transmitted to the worm wheel through a one-way clutch.

12. The printer according to claim 10, wherein only any one of the forward and reverse rotations of the head driving motor is transmitted to the worm through a one-way clutch.

* * * * *